United States Patent [19]

Karino et al.

[11] 4,377,141

[45] Mar. 22, 1983

[54] LOW SPEED FUEL SUPPLY SYSTEM FOR A CARBURETOR

[75] Inventors: Kimiji Karino; Tokuo Kosuge, both of Katsuta, Japan

[73] Assignee: Hitachi, Ltd., Tokyo, Japan

[21] Appl. No.: 288,497

[22] Filed: Jul. 30, 1981

[30] Foreign Application Priority Data

Jul. 30, 1980 [JP] Japan ..... 55-104665

[51] Int. Cl.[3] ..... F02M 3/08; F02M 13/04; F02M 1/10

[52] U.S. Cl. ..... 123/438; 261/121 A; 261/411 D

[58] Field of Search ..... 123/438, 440, 339; 261/121 A, 41 D

[56] References Cited

U.S. PATENT DOCUMENTS

| | | | |
|---|---|---|---|
| 3,554,500 | 1/1971 | Hidey | 261/41 D |
| 4,060,573 | 11/1977 | Mori et al. | 261/41 D |
| 4,246,875 | 1/1981 | Bier et al. | 123/438 |
| 4,279,841 | 7/1981 | Stettner | 123/438 |
| 4,333,890 | 6/1982 | Karino et al. | 261/41 D |

*Primary Examiner*—Raymond A. Nelli

*Attorney, Agent, or Firm*—Antonelli, Terry & Wands

[57] ABSTRACT

A low speed fuel supply system for a carburetor of an engine, with the system including an ascending fuel passage communicating with a fuel supply. A fuel-air passage is provided with an air bleed at an upper end, with the fuel-air passage opening, at the upper end thereof, into an induction passage of the carburetor upstream of a throttle valve mounted across the induction passage. A lower end of the fuel-air passage communicates with the induction passage in a vicinity of the throttle valve. A horizontally disposed fluid passage is provided for connecting both the upper ends of the fuel-air passage and the ascending fuel passage. The horizontally disposed fluid passage forms a valve seat, with a guide member being provided forming a valve body disposed in alignment with the valve seat. An air bleed introduces air into the upper portion of the ascending fuel passage directly toward the valve body. By operation of the low pressure induced in the induction passage, fuel is sucked from the fuel supply, guided by the valve body, and directed to the valve seat, while air introduced from the air bleed is directed to the valve body. The air and fuel are divided into two layers and flow into the valve seat. The flows of two layers into the fuel-air passage, with fuel flowing while adhering on a wall of the fuel-air passage and the air flows along a central portion of the flowing fuel, while the fuel adheres to the wall of the induction passage so that an annular flow is formed and a stable and continuous flow can be effected.

17 Claims, 3 Drawing Figures

LOW SPEED FUEL SUPPLY SYSTEM FOR A CARBURETOR

The present invention relates to a supply system and, more particularly, to a low speed fuel supply system for a carburetor wherein a state of fuel flow in a low speed fuel system is significantly improved.

In order to purify exhaust gases for motor vehicles and to reduce the consumption of fuel for motor vehicles, it is necessary to improve a low speed fuel supply system of a carburetor and, more particularly, it is important to supply a stable amount of fuel suitable for running at the time of operation of a small amount of fuel supplied such as, for example, during an idling operation of the engine.

In, for example, Japanese Laid Open Patent Application No. 52-122731, a low speed fuel supply system is proposed wherein a rising or upwardly extending passage is provided which is connected at a lower end to a fuel supply or container, with a descending passage opening at a lower end into a fuel-air induction passage in a vicinity of a throttle valve. A horizontal passage connects an upper portion thereof to both the rising and descending passages so that fuel from the fuel supply or container is introduced into the fuel-air induction passage through the rising and descending passages.

A disadvantage of the above mentioned proposed system resides in the fact that air is introduced into the fuel rising in the rising passage resulting in a bubbling of the same. While initially small air bubbles ascend in the rising passage and accompany the fuel, some of the small air bubbles are grouped or gathered into larger air bubbles and the mixture of the air bubbles and fuel after passing the horizontal passage descend in the descending passage while the air bubbles are mixed with air added through the air bleed provided on an upper portion of the descending passage thereby growing into larger air bubbles. The fuel and air bubbles in the descending passage are arranged in order and pass the passsage so that the fuel is to be intermittently jetted into the induction passage.

As can readily be appreciated a mixing of air with the fuel in the rising passage reduces the apparent density thereof and serves for increasing or raising the fuel in the raising passage and therefor increasing the responsibility or capacity of the fuel supply; however, such mixing of air brings about a variation of the amount of fuel supplied in the induction passage and prevents a smooth running of the car.

The aim underlying the present invention essentially resides in providing a low speed fuel supply system for a carburetor which improves a running performance of an internal combustion engine during a low speed operation.

Advantageously, in accordance with the present invention, a low speed fuel supply system for a carburetor is provided which includes a means for defining an induction passage which opens at one end into an atmospheric pressure and connects at the other end to the internal combustion engine. A throttle valve is rotatably mounted across the induction passage for controlling an air-fuel flow through the induction passage, with an ascending fuel passage means communicating at a lower end with fuel in a fuel container or supply. Fuel-air passage means are connected at one end to an upper end portion of the ascending fuel passage means and are open at the other end into an induction passage in a vicinity of the throttle valve. Guide means are disposed in the ascending fuel passage means around a joining portion of the ascending fuel passage means and the fuel air passage means for directing fuel ascending from the fuel container to the fuel-air passage means. A first air bleed means is provided for introducing air into an upper portion of the ascending fuel passage means so that the air flows mainly along the upper portion of the guide means to the fuel-air passage means, whereby the fuel and air flows are divided into two layers at an upper portion of the ascending fuel passage means.

In accordance with further features of the present invention, the ascending fuel passage means is connected to the fuel-air passage means by a horizontal passage means, with an axis of the guide means being aligned with the horizontal passage means.

Advantageously, the fuel-air passage means includes a second air bleed means provided at the upper end, with the second air bleed means opening into the induction passage upstream of the throttle valve and intoducing air into the fuel-air passage means.

The first air bleed means in accordance with the present invention is disposed or arranged in a position so as to oppose the guide means.

The ascending fuel passage means of the present invention includes a fine hole portions such that a fuel level is raised more than several times the fine hole diameter by virture of capillary forces.

Advantageously, the guide means of the present invention is a valve portion of a run-on control solenoid valve, with the horizontal passage means being a valve seat engaging with the valve portion while the run-on control solenoid valve is operating.

By virtue of the provision of the guide means in accordance with the present invention, the air flow is guided from the air bleed and fuel in the ascending passage so that the air and fuel are made into two layers and flow into the fuel-air mixture passage. The fuel layer of the air layer and fuel layer is disposed lower than the air layer so that when the fuel and air descends in the fuel passage the fuel flow is annular and the air passes through the annular fuel flowing into the fuel-air passage. Consequently, the fuel is continuously supplied into the induction passage around the throttle valve.

Accordingly, it is an object of the present invention to provide a low speed fuel supply system for a carburetor which avoids, by simple means, shortcomings and disadvantages encountered in the prior art.

Another object of the present invention resides in providing a low speed fuel supply system for a carburetor which effects a stable fuel supply during a low speed operation of the internal combustion engine.

A further object of the present invention resides in providing a low speed fuel supply system for a carburetor which functions reliably under all operating conditions of the internal combustion engine.

Yet another object of the present invention resides in providing a low speed fuel supply system for a carburetor which ensures a smooth running of an engine.

Yet another object of the present invention resides in providing a low speed fuel supply system for a carburetor which is simple in construction and therefore relatively inexpensive to manufacture.

These and other objects, features, and advantages of the present invention will become more apparent from the following description when taken in connection with the accompanying drawings which show, for the purposes of illustration only, two embodiments in accordance with the present invention, and wherein.

Figure 1:
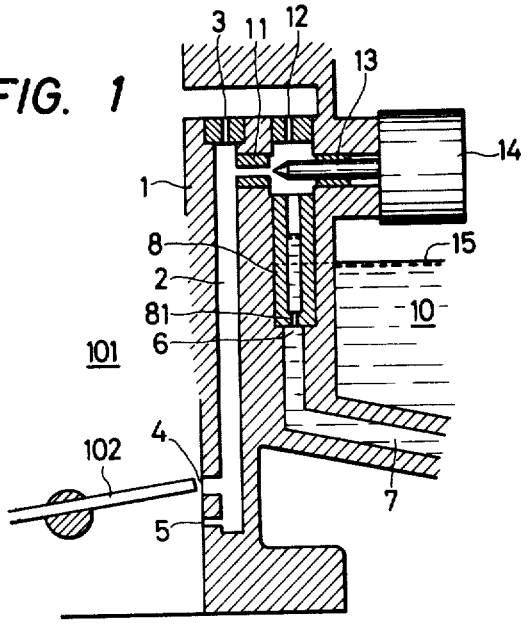
FIG. 1 is a partial cross sectional view of a first embodiment of a low speed fuel supply system for a carburetor constructed in accordance with the present invention.
Figure 2:
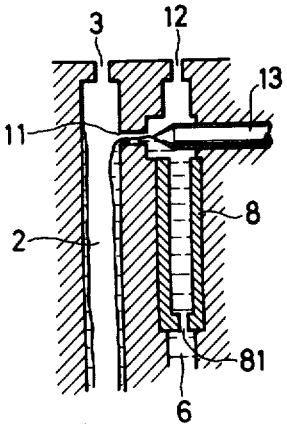
FIG. 2 is a cross sectional detailed view, on an enlarged scale, of a portion of the low speed fuel supply system of FIG. 1.

Referring now to the drawings wherein like reference numerals are used throughout the various view to designate like parts and, more particularly, to FIGS. 1 and 2, according to these figures, a carburetor body 1 defines an induction passage 101 in which is arranged a rotatably mounted throttle valve 102. A vertically extending fuel air passage 2 is provided in the carburetor body 1, with the fuel-air passage 2 opening at an upper end, through an air bleed 3, into the induction passage 101 in a position upstream of the throttle valve 102. A lower end of the fuel-air passage 2 opens into the induction passage 101 in a vicinity of the throttle valve 102 through a bypass opening or hole 4 and an idle hole or opening 5. An upwardly extending or ascending fuel passage 6 includes a bore or aperture 7, with a lower end of the fuel passage 6 being connected to and communicating with a fuel container or float chamber 10. An upper portion of the fuel passage 6 is connected to a horizontal passage 11. A horizontal passage 11 is constructed as a valve seat and connects the fuel passage 6 with fuel-air passage 2. An air bleed 12 is provided at an upper end of the fuel passage 6 and a valve 13 is provided for preventing a run-on operation of the engine. The valve 13 is disposed in alignment with the longitudinal axis of the valve seat 11. The valve 13 is mechanically connected to a solenoid 14 which forms a run-on control solenoid valve arrangement.

The fuel pipe 8 has an inner diameter of about 1.6 mm and is provided, at a lower end thereof, with a slow jet 81. A distance between a fuel level 15 in the fuel container of flow chamber 10 and the valve 13 is about 10 mm. Fuel is raised in the fuel pipe 8 above the fuel level 15 by about 5 mm due to capillary forces when there is no fluid flow in the induction passage 101, with the fuel being more responsive to the lower pressure, that is, the fuel can more easily flow into the induction passage 101.

As shown most clearly in FIG. 2, when an idling operation of an engine is effected, fuel drawn up through the slow jet 81 is easily raised to the upper portion or chamber containing the valve 13. The fuel reaching the valve 13 contacts with and adheres to a lower side of the valve 13 and flows to the valve seat 11 along the valve 13. On the other hand, air is introduced through the air bleed 12 by the vacuum applied in the induction passage 101 of the throttle valve portion. The air from the air bleed is directed to and impinges upon the valve 12 and, at the valve 12, the air spreads and the fuel is compressed. Therefore, the air and fuel form two layer flows shown most clearly in FIG. 2 with the fuel flowing at a lower side of the valve seat 11 and the air at the upper side thereof. The fuel entering the fuel passage 2 is pressed along the wall by the air and the air from the air bleed 3 so as to form a film along the walls of the fuel air passage 2, which film descends along the wall. The fuel and descending air have an annular shaped flow and are introduced in the induction passage 2 through the bypass hole 4 and idling hole 5.

With the fuel and air flowing in two layers, a surface of the fuel is disposed to the air flow so that a gasification or vaporization of the fuel is promoted and the fuel and air to be entered into the deflection passage 2 form a uniform mixture of fuel-air which is not variable in density.

With an internal combustion engine supplied with a fuel-air mixture resulting from the construction of the present invention, the engine operates smoothly and, since the fuel is combusted effectively, an amount of fuel consumption is relatively small and a purification of the exhaust gases by utilization of catalysts can more easily be effected. Moreover, even if the phenomenon of the generation of a considerable number of fine bubbles in the fuel pipe occurs including the slow jet 81 at the time of a high temperature operation of the engine in, for example, summer, and also after a high load operation, the fuel can be discharged through the air bleed 12 so that the pressure in the chamber containing the valve 13 is prevented from rising. Therefore, fuel accompanied by bubbles does not enter the fuel-air mixture through the seat 11 so that the fuel-air ratio of the fuel-air mixture passing through the induction passage is not changed by the fuel accompanied by the air bubbles.

Moreover, in the above described construction, it is not necessary to provide air supply means at the lower portion of the fuel pipe 8 as in previously proposed low speed fuel-supply systems; therefore, the resulting construction is simple and the number of components of the overall system is reduced thereby resulting in a carburetor which can be made not only compact but which also may be manufactured at a relatively low cost.

In the construction of FIGS. 1 and 2, the valve 13 for controlling the run-on operation serves as a guide means; however, for such valve means for preventing a run-on or dieseling is not provided, the same effect could be obtained by providing a fixed guide member or rod at the position of the valve 13.

Figure 3:
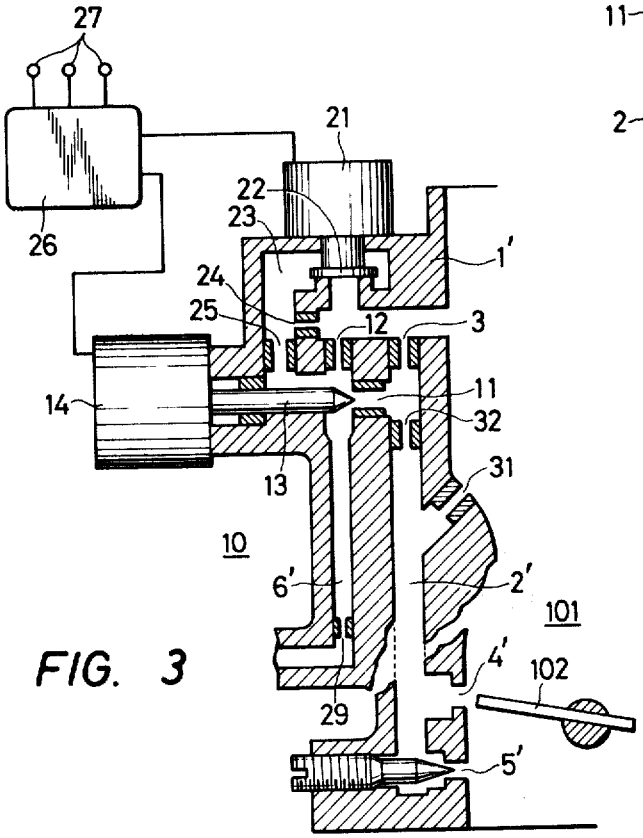
FIG. 3 is a cross sectional view of another embodiment of a low speed fuel supply system for a carburetor constructed in accordance with the present invention.

FIG. 3 provides an example of another embodiment of a low speed fuel supply system for a carburetor and, according to this figure, an ascending or vertically extending fuel passage 6', provided with a slow jet or throttling portion 29 communicates at a lower end thereof with a fuel container of float chamber 10 and, at an upper end portion thereof, with a fuel-air passage 2' through a valve seat 11. The fuel-air passage 2' is provided at an upper end thereof with an air bleed 3 and at a lower end thereof with a bypass hole 4' and an idle hole 5'. The bypass hole 4' and idle hole 5' communicate with the induction passage 101, defined or formed in a carburetor body 1', in an area of a throttle valve 102. The fuel-air passage 2 is provided with a throttle or restrictor 32 and an air bleed 31. The air bleed 31 introduces air into the fuel air passage 2 so as to prevent a fluctuation of the pressure in the fuel-air passage 2.

As with the construction of FIGS. 1 and 2, a valve 13, connected to a solenoid 14 for controlling a run-on or dieseling operation of the engine is disposed in alignment with the valve seat 11 in an upper portion of the ascending fuel passage 6'. An air bleed 12 is provided so as to face an end of the fuel passage 6. An air passage 23, opening into atmospheric pressure through the induction passage 101 and communicating with an upper portion of the passage 6 is formed above the valve 13. The air passage 23 includes a valve 22 which is adapted to be actuated by a solenoid 21, an air bleed 24, and a throttle or air restrictor 25. A solenoid 21 which actuates the valve 22 is electronically connected to various sensors 27 through a comparator 26 of conventional construction. The sensors 27 are adapted to detect, for example, a density of oxygen in the exhaust gas from the engine, operational or load status of the engine, and transmit electric signals to the comparator 26. If a larger amount of air as compared with fuel is desireable, the solenoid 21 actuates the valve 22 with the instructions for actuation being supplied by the comparator 26 so that air is added to the fuel in addition to air from the air bleeds 12 and 24 thereby providing a desired fuel-air ratio in dependence upon the conditions detected by the sensor 27. If the sensors 27 detect a stopping of the engine, the solenoid 14 actuates the valve 13 to close the valve seat 11 so that the fuel supply from the fuel container or float chamber 10 is stopped.

During an idling of the engine, fuel from the fuel container or float chamber 10 rises or ascends in the ascending fuel passage 6, reaches the valve 13 and is guided by an undersurface of the valve 13 so as to be directed to the valve seat 11. On the other hand, air introduced into the upper portion of the ascending fuel passage 6 flows along the upper face of the valve 13 so as to be directed to the valve seat 11. The air-fuel are divided into two layers by the valve 13 so that the fuel and air flow in the valve seat is composed of two layers. The fuel layer is disposed at a lower side of the two layers and adheres to the wall of the fuel-air passage 2' due to the operation of supply of air from the various air bleeds and more particularly, the air bleed 3 when the fuel layer enters the fuel-air passage 2'. As with the construction of FIGS. 1 and 2, the air flows in an annular passage surrounded by a fuel flow so as to result in an annular fuel-air flow in the fuel-air passage 2. As can readily be appreciated, the construction of FIG. 3 is capable of achieving the same overall effects as the construction of FIGS. 1 and 2. Moreover, even if the air bleed 12 is omitted, the same effect may be achieved by increasing the amount of air introduced from the air bleed 24.

While we have shown and described ony two embodiments in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. A low speed fuel supply system for a carburetor, characterized in that an induction passage means is provided for supplying a fuel-air mixture to an engine, a throttle valve means is rotatably mounted in the induction passage means for controlling the air fuel flow through the induction passage means, an ascending fuel passage means has a lower end communicating with a fuel supply means, a fuel-air passage means has an upper end portion connected to an upper end portion of the ascending fuel passage means and a lower end portion connected to the induction passage means in a vicinity of the throttle valve means, means are disposed in the ascending fuel passage means for directing fuel ascending from the fuel supply means in the ascending fuel passage means to the fuel-air passage means, and in that means are provided for introducing air into the upper end portion of the ascending fuel passage means so that the air flows mainly along an upper portion of the fuel directing means, whereby the fuel and air flows are divided into two layers at the upper portion of the ascending fuel passage means.

2. A low speed fuel supply system according to claim 1, characterized in that a first end of the induction passage means communicates with the atmosphere and a second end communicates with the engine, the fuel directing means includes a guide means arranged in an area wherein the ascending fuel passage means and the fuel-air passage means are joined.

3. A low speed fuel supply system according to claims 1 or 2, characterized in that a horizontally extending passage means is provided for connecting the fuel-air passage means with the ascending fuel passage means, and in that a longitudinal axis of the fuel directing means is aligned with the horizontal passage means.

4. A low speed fuel supply system according to claim 3, characterized in that means are provided at the upper end portion of the fuel-air passage means for introducing air into the fuel-air passage means, said last-mentioned means opening into the induction passage means at a position upstream of the throttle valve means.

5. A low speed fuel supply system according to claim 4, characterized in that the means for introducing air into the upper end portion of the ascending fuel passage means and the means for introducing air into the fuel-air passage means are respectively constructed as first and second air bleed means.

6. A low speed fuel supply system according to claim 5, characterized in that the first air bleed means is arranged at a position opposite the fuel directing means.

7. A low speed fuel supply system according to claim 6, characterized in that the ascending fuel passage means includes a portion having a reduced diameter so as to enable a fuel level in the fuel passage means to be raised by capillary force to a level greater than at least several times a diameter of the reduced diameter portion of the ascending fuel passage means.

8. A low speed fuel supply system according to claim 7, characterized in that means are provided for preventing a dieseling of the engine, said fuel directing means forms a valve portion of the dieseling preventing means, and in that the horizontal passage means forms a valve seat for engagement with said valve portion when the dieseling preventing means is actuated.

9. A low speed fuel supply system according to claim 8, characterized in that the dieseling preventing means is a control solenoid valve.

10. A low speed fuel supply system according to one of claims 1 or 2, characterized in that means are provided at the upper end portion of the fuel-air passage means for introducing air into the fuel-air passage means, said last-mentioned means opening into the induction passage means at a position upstream of the throttle valve means.

11. A low speed fuel supply system according to claim 10, characterized in that the means for introducing air into the upper end portion of the ascending fuel passage means and the means for introducing air into the fuel-air passage means are respectively constructed as first and second air bleed means.

12. A low speed fuel supply system according to claim 11, characterized in that the first air bleed means is arranged at a position opposite the fuel directing means.

13. A low speed fuel supply system according to one of claims 1 or 2, characterized in that the ascending fuel passage means includes a portion having a reduced diameter so as to enable a fuel level in the fuel passage means to be raised by capillary force to a level greater than at least several times a diameter of the reduced diameter portion of the ascending fuel passage means.

14. A low speed fuel supply system according to one of claims 1 or 2, characterized in that means are provided for preventing a dieseling of the engine, said fuel directing means forms a valve portion of the dieseling preventing means, the valve portion is cooperable with a valve seat when the dieseling preventing means is actuated.

15. A low speed fuel supply system according to claim 14, characterized in that an air passage means is provided and communicates with the upper portion of the fuel-air passage means, valve means are provided for controlling the flow of air through the air passage means, a solenoid means is provided for controlling said last-mentioned valve means, means are provided for sensing operating parameters of the engine, comparator means are connected to the sensing means for comparing output signals from the sensing means and for providing control signals to the dieseling preventing means and solenoid means so as to control a fuel-air ratio in the carburetor.

16. A low speed fuel supply system according to claim 15, characterized in that means are provided in the fuel-air passage means for preventing fluctuation of pressure in the fuel-air passage means.

17. A low speed fuel supply system according to claim 16, characterized in that the pressure fluctuation preventing means includes an air bleed means communicating with the induction passage means.

* * * * *